US008362445B2

(12) United States Patent
Short et al.

(10) Patent No.: US 8,362,445 B2
(45) Date of Patent: Jan. 29, 2013

(54) UV-LED IONIZATION SOURCE AND PROCESS FOR LOW ENERGY PHOTOEMISSION IONIZATION

(75) Inventors: Luke C. Short, West Richland, WA (US); Charles J. Barinaga, West Richland, WA (US); Robert G. Ewing, Kennewick, WA (US)

(73) Assignee: Battelle Memorial Institute, Richland, WA (US)

( * ) Notice: Subject to any disclaimer, the term of this patent is extended or adjusted under 35 U.S.C. 154(b) by 78 days.

(21) Appl. No.: 13/076,270

(22) Filed: Mar. 30, 2011

(65) Prior Publication Data

US 2012/0248301 A1 Oct. 4, 2012

(51) Int. Cl.
*H01J 27/00* (2006.01)

(52) U.S. Cl. ..... 250/423 R; 250/423 P; 250/281; 250/282; 250/283; 250/287; 250/288; 250/289; 250/290; 250/291; 250/292

(58) Field of Classification Search ..... 250/423 R, 250/423 P, 281–283, 287–292
See application file for complete search history.

(56) References Cited

U.S. PATENT DOCUMENTS

| | | | | |
|---|---|---|---|---|
| 4,733,086 | A | 3/1988 | Simmonds | |
| 4,998,019 | A * | 3/1991 | Stokowski et al. | 250/360.1 |
| 5,300,773 | A | 4/1994 | Davies | |
| 5,431,714 | A | 7/1995 | Burtscher et al. | |
| 5,773,833 | A | 6/1998 | Hsi | |
| 6,828,576 | B2 | 12/2004 | Spivak | |
| 6,921,929 | B2 | 7/2005 | LeBoeuf et al. | |
| 7,229,467 | B2 | 6/2007 | Spivak | |
| 7,304,298 | B2 | 12/2007 | Swenson et al. | |
| 8,097,845 | B2 * | 1/2012 | Roach et al. | 250/288 |
| 2007/0114395 | A1 * | 5/2007 | Swenson et al. | 250/292 |
| 2008/0043397 | A1 | 2/2008 | Sun et al. | |
| 2008/0191137 | A1 | 8/2008 | Poteet et al. | |
| 2010/0025703 | A1 * | 2/2010 | Towns et al. | 257/98 |
| 2010/0110728 | A1 | 5/2010 | Dubrow et al. | |

OTHER PUBLICATIONS

Chen et al. "Bipolar Ionization sourcefor Ion Mobility Spectrometry based on Vacuum Ultraviolet Radiation Induced Photemission and Photoionization" Analytical Chemistry, vol. 82, No. 10, May 15, 2010 pp. 4151-4157.*

Sun et al. "LED deep UV source for charge management of gravitational reference sensors", Class. Quantum. Grav, 23 2006, S141-S150.*

Feuerbacher et al. :Experimental Investigation of Phtoemission from Satellite surface materials, J. Appl. Phys. vol. 43, No. 4, Apr. 1972, pp. 1563-1572.*

Eiceman, G.A., et al., Ion Mobility Spectrometry, Second Edition, Taylor & Francis Group, LLC, Boca Raton, FL, 2005, 4-5.

Ewing, R.G., et al., Mechanisms for negative reactant ion formation in an atmospheric pressure corona discharge, Int. J. Ion. Mobil. Spec., 12, 2009, 65-72.

* cited by examiner

*Primary Examiner* — Jack Berman
*Assistant Examiner* — Meenakshi Sahu
(74) *Attorney, Agent, or Firm* — James D. Matheson

(57) ABSTRACT

A UV-LED photoemission ionization source and process are disclosed that provide ionization of analytes including volatile molecular species and organic residues for detection with various ion analyzers. The UV-LED source produces low-energy UV light (200 nm to 400 nm) that yields photoemission electrons from various conducting surfaces. These photoemission electrons provide direct and indirect ionization of analytes including trace organic residues without need of high electric fields.

32 Claims, 7 Drawing Sheets

UV-LED IONIZATION SOURCE AND PROCESS FOR LOW ENERGY PHOTOEMISSION IONIZATION

FIELD OF THE INVENTION

The present invention relates generally to ionization sources and systems. More particularly, the invention relates to a UV-LED ionization device that includes a UV-LED ionization source and process that produces photoemission electrons for indirect or direct ionization of analytes.

BACKGROUND OF THE INVENTION

Attention in the scientific community has avoided exploring LEDs as a viable light source because of their low light intensity (i.e., photon flux) or low photon energy. UV LEDs in the region of 240 nm to 280 nm are now becoming commercially available, although their flux is still limited. Traditional photon-based ion sources have either very high photon energies (e.g., Vacuum UV or VUV lamps and lasers) resulting in direct photo-ionization via Single Photon Ionization (SPI) or via a high intensity or focused laser beam(s), resulting in Multi-Photon Ionization (MPI) or Resonance-Enhanced Multi-Photon Ionization (REMPI). Other UV-laser techniques including, e.g., UV Pulsed-Laser Fragmentation (UV-PLF) have been successfully used to measure photo-fragments of explosive residues using a focused UV laser (MPI). However this approach requires a focused laser beam to permit MPI, and resulting ions are not the parent or close-parent ion fragments, but $NO_2$. With photons that have an energy of between 4 eV to 5 eV per, current UV LEDs lack the ability to directly photo-ionize organic or atmospheric components. In addition, the light from a UV LED has both insufficient energy, for SPI to occur (most organic molecules ionize at >8 eV) and a photon flux that is too low for MPI or REMPI to occur. Photon flux ($\phi$) [(photons/sec)] measured at a distance from an LED is given by Equation [1]:

$$\phi = P/(1.602\times10^{-19}\,J*1240\text{ nm}/\lambda) \quad [1]$$

Here, (P) is the measured power (Watts), and ($\lambda$) is the wavelength (nm). For currently available UV-LEDS, LEDs with 280 nm and a power of 500 μW generates $7\times10^{14}$ photons/sec, whereas a UV-LED at 240 nm and 22 μW generates $3\times10^{13}$ photons/sec. Thus, currently available UV-LEDs are incapable of generating ions via SPI, MPI, or REMPI. Accordingly, new devices and approaches are needed that can take advantage of these low-energy, low-flux light sources to ionize selected organics for analysis.

SUMMARY OF THE INVENTION

The present invention includes a UV-LED ionization device that includes a UV-LED photoemission ionization source and process for indirect chemical ionization or direct electron capture ionization of analytes for ion analysis. The UV-LED ionization source does not include another electron-generating source, e.g., electron-generating filaments, beta-emitting sources, or other electron-generating sources. The UV-LED ionization source produces UV light of a selected wavelength that generates photoemission electrons from the conducting surface when energy of the UV light exceeds the work function upon contact with the conducting surface. The photoemission electrons provide ionization of an analyte.

The process for UV-LED photoemission ionization includes generating UV light of a preselected wavelength with the UV-LED source in the absence of another electron-generating source. UV light from the UV-LED source contacts a conducting surface that includes a preselected material located adjacent the UV-LED source to generate photoemission photoelectrons from the conducting surface when energy of the UV light exceeds the work function of the surface upon contact with the conducting surface. A preselected analyte is then ionized with photoemission electrons released from the conducting surface directly or indirectly upon contact with the analyte. The method can further include the step of determining the ionized analyte in an ion analyzer for identification.

In some embodiments, the analyte is located on the conducting surface. In other embodiments, the analyte is a vapor-phase analyte.

In another embodiment, the analyte is located on a non-conducting surface and ionized by photoemission electrons released from the conducting surface.

In one embodiment, the UV-LED source is located in the same ionization volume as the analyte.

In one embodiment, the UV-LED ionization source is positioned adjacent a conducting surface made of a preselected material.

In one embodiment, the UV-LED source is coupled to an ion analyzer located adjacent the conducting surface.

In a preferred embodiment, the UV light is non-coherent UV light. In a preferred embodiment, the UV-LED source provides UV light of a wavelength from about 200 nm to about 400 nm. The UV-LED source is characterized in that it produces a low quantity of ozone as a by-product of the ionization of the analyte. In some embodiments, the quantity of ozone is below about 100 parts per billion (ppb). In other embodiments, the quantity of ozone produced is a quantity of ozone below a monolayer of ozone coverage on the conducting surface.

In various embodiments, the conducting surface includes preselected materials including, but not limited to, e.g., metals, alloys, metalloids, and polymers.

In various embodiments, the conducting surface includes a metal. In various embodiments, the form of the metal conducting surface includes, e.g., a mesh, a foil, a coating, or a bulk material. In other embodiments, the conducting surface includes a metal alloy. In one embodiment, the conducting surface includes a metal alloy composed of stainless steel.

In another embodiment, the conducting surface includes a metalloid.

In some embodiments, the conducting surface includes a modified surface. In some embodiments, the modified surface includes a metal coating. In some embodiments, the modified surface includes an oxidized metal. In some embodiments, the oxidized metal is oxidized with air or oxygen gas. In some embodiments, the oxidized metal is oxidized with a reagent that leaves oxygen on the surface of the metal. The oxidizing reagent can include an acid, an acid gas, a base, or another like reagent. Exemplary acids include, e.g., nitric ($HNO_3$), phosphoric ($H_3PO_4$), and sulfuric ($H_2SO_4$). An exemplary base is sodium hydroxide (NaOH). In some embodiments, the modified surface includes a polymer coating. In some embodiments, the modified surface includes a conductive polymer.

In various embodiments, analytes ionized in accordance with the invention include, but are not limited to, e.g., vapor-phase analytes, liquid-phase analytes, solid-phase analytes, vapor-phase analytes, residues, explosives, including analytes in these various forms. In some embodiments, the analyte is a liquid residue. In other embodiments, the analyte is a solid residue. In yet other embodiments, the analyte is a vapor or gas-phase analyte. In some embodiments, the analyte is ionized from off a conducting surface. In some embodiments, the analyte is located on or in an organic-containing matrix located on the conducting surface. In some embodiments, the analyte is an explosive. Examples include, but are not limited to, e.g., TNT, RDX, PETN, or mixtures of these explosives.

In some embodiments, ionization of the analyte occurs at a pressure at or above ambient pressure. In other embodiments, ionization of the analyte occurs at a reduced pressure. In one embodiment, the reduced pressure is a vacuum pressure. In some embodiments, ionization of the analyte occurs at a temperature greater than or equal to ambient temperature. In some embodiments, ionization of the analyte occurs at a temperature less than or equal to ambient temperature.

In some embodiments, the UV-LED is adapted for use in portable mass analyzers including, e.g., MS, IMS, and like instruments that generate ions at atmospheric pressure that provide both an increase in ion intensity and a reduction in size of the instruments.

In various embodiments, the UV-LED source is coupled to an ion analyzer positioned adjacent the conducting surface to provide analysis of ionized analytes, and the method further includes determining the ionized analyte in an ion analyzer for identification of the analyte.

In some embodiments, the ionizing of the analyte involves a proton abstraction (removal) reaction. In some embodiments, the ionizing of the analyte involves formation of a chemical adduct in the vapor phase. In some embodiments, the ionizing analyte is fragmented to form ion and neutral products. In some embodiments, the ionizing of the analyte involves a charge-transfer reaction with a reagent gas. In various embodiments, the reagent gas is selected from: $SF_6$, $NO_2$, OH, $O_2$, $O_3$, $CH_3OH$, $CH_3CN$, $CH_3COOH$, HCl, $NH_3$, $CH_4$, $CH_2Cl_2$, $CF_2Cl_2$, $C_4H_{10}$, halogenated hydrocarbons, including combinations of these gases. In some embodiments, the ionizing of the analyte involves an electron capture reaction with an emitted photoemission electron. In some embodiments, the ionizing of the analyte involves an electron capture reaction with oxygen. In other embodiments, the ionizing involves an electron capture reaction with emitted photoemission electrons. In various embodiments, photoemission ionization via electron capture (EC) is used to ionize samples that provides for detection of various chemical species in ambient air.

In one embodiment, electron capture (EC) ionization is performed at ambient pressure to provide a softer ionization approach than is obtainable with conventional, low-pressure EC ionization, which yields simpler mass spectra and higher parent ion yields.

In some embodiments, photoelectrons are generated on a surface that is separate from the surface on which the sample is placed. In these embodiments, the sample can be a liquid residue or a solid residue. In some embodiments, the surface is a non-conductive surface. In some embodiments, the non-conductive surface includes a glass, a polymer, a ceramic, or a ceramic glass. In some embodiments, a non-conducting surface provides the mounting surface for the analyte, and a conducting surface provides the source of photoemission electrons. In some embodiments, the conducting surface is positioned separate from or distal to the non-conducting surface to provide the necessary electrons for ionization of the sample from off the non-conducting surface.

In some embodiments, photoelectrons are generated from the metal surface (e.g., oxidized aluminum or stainless steel) via impinging low-energy UV light (280 nm) generated by a single UV-LED operating at atmospheric pressure. The UV-LED source generates small photocurrents in the metals and has the potential to replace traditional Electron Impact (EI) sources. Low-energy photoelectrons result in both direct electron capture by the analyte, or via chemical ionization with $O_2^-$. Ion generation occurs without use of high electric fields such as corona discharge or ESI. As such, no disrupting electric fields are generated in the source region.

BRIEF DESCRIPTION OF THE DRAWINGS

A more complete appreciation of the invention will be readily obtained by reference to the following description of the accompanying drawing in which like numerals in different figures represent the same structures or elements.

DETAILED DESCRIPTION OF THE INVENTION

Figure 1:
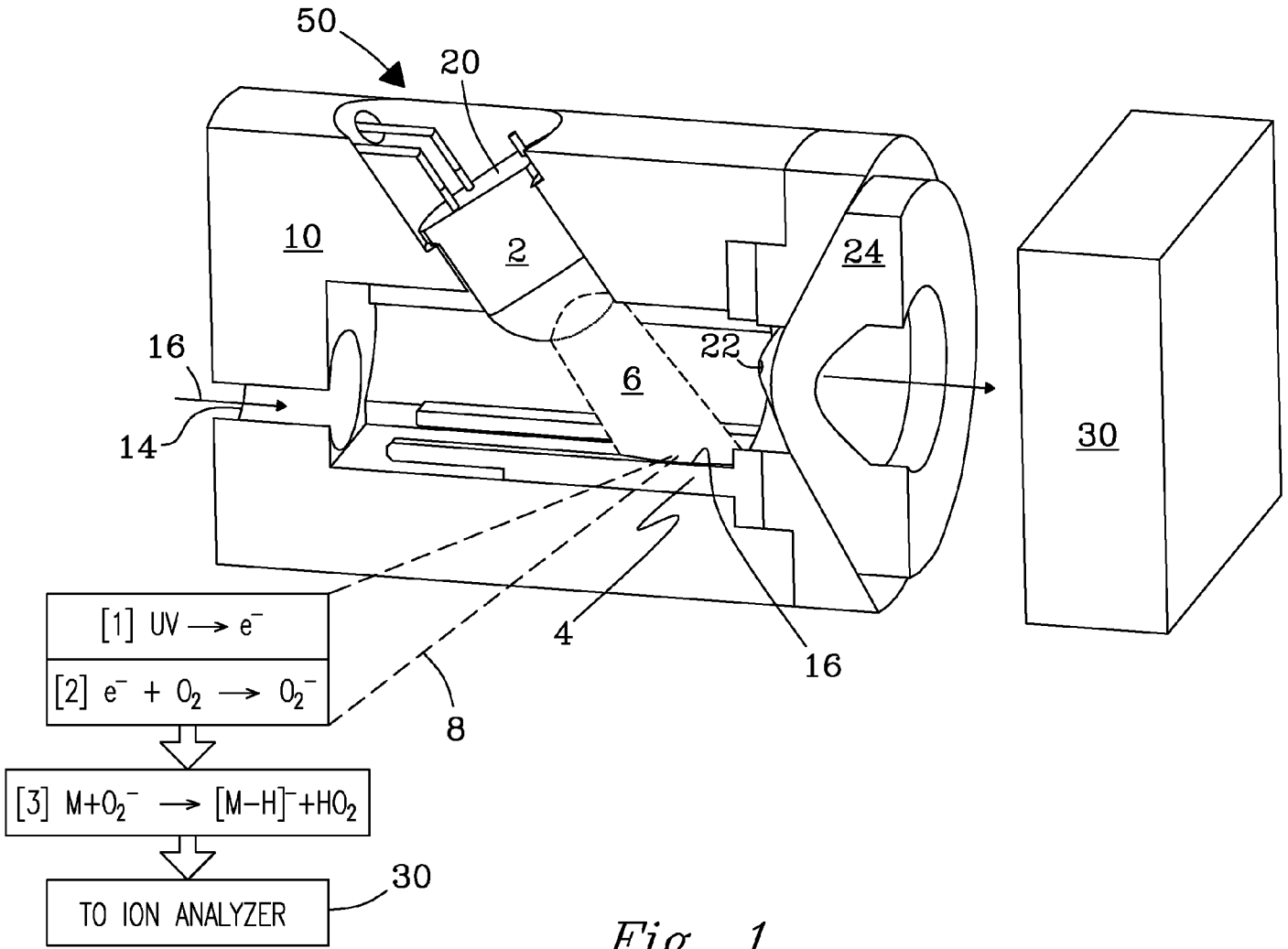
FIG. 1 is a schematic of a UV-LED ionization source for generating photoemission electrons, according to one embodiment of the invention.

A UV-LED photoemission ionization source and process are detailed that generate photoemission electrons that provide indirect ionization or direct electron capture ionization of analytes including, e.g., volatile organic vapors and surface residues via low-energy electron capture and subsequent ion-neutral reactions that find application in mass spectrometry or ion mobility spectrometry. FIG. 1 shows a UV-LED ionization device 50 that provides for photoemission ionization of analytes 16, according to one embodiment of the invention. UV-LED ionization device 50 includes a UV-LED ionization (ion) source 2. UV-LED ion source 2 includes a UV-LED (e.g., a 280 nm UV-LED, FWHM 10 nm, 700 μW) available commercially (e.g., a UVTOP 280 UV-LED, Sensor Electronic Technology, Inc., Columbia, S.C., USA) that delivers non-coherent UV light 6. UV-LED ion source 2 provides ionization of analytes 16 that relies on photoemission electrons 8 generated via the Photoelectric Effect from conducting surface 4, generating ions via low-energy electron capture and subsequent ion-neutral reactions in concert with photoemission electrons released from conducting surface 4. UV-LED ion source 2 is driven by a Laser Diode Driver 20 (e.g., a model 501, 26 mA, current-limited Laser Diode Driver, Newport Corporation, Irvine, Calif., USA). In the instant configuration, Laser Diode Driver 20 generates a measured power output of 700 μW, but is not limited thereto. UV-LED ionization (ion) source 2 generates photoemission electrons from conducting surface 4 without the need for other electron-generating sources including, e.g., electron-generating filaments, or particle beam emitting elements and sources.

Ion generation also occurs without need for high electric fields including, e.g., corona discharge, electrospray ionization, nor does it require radioactive sources, such as $^{63}$Ni for electron emission. Absence of these electron-generating sources reduces complexity and cost of various embodiments of the invention. In some embodiments, device 50 includes a housing 10 composed of preselected materials including, but not limited to, e.g., metals, alloys, plastics, glasses, including combinations of these various materials. In some embodiments, housing 10 is preferably composed of a metal or metal-containing alloy, which allows analyte 16 to be mounted on a non-conducting surface 4, but is not limited thereto. In one embodiment, UV-LED ionization device 50 includes a vapor/gas sample inlet 14 that is coupled to a gas source (not shown) to deliver a vapor-phase analyte 16 into the path length of UV light 6 emanating from UV-LED source 2. Sample inlet 14 can also be used to provide a source of clean air to reduce background ions, or to provide a gas flow that guides ions into the mass analyzer 30, or to provide a source of reagent gas (e.g., as described previously herein) for improved ionization of the analyte 16. No limitations are intended. Photoemission electrons 8 from conducting surface 4 combine with analyte 16 either directly or indirectly ionizing the analyte 16. The ionized analyte 16 exits through the sample inlet 22 of sample cone 24, providing entrance to a coupled ion analyzer 30 (e.g., a mass spectrometer, an IMS, and like instruments) for analysis of the gas-phase analyte 16. In another embodiment, an analyte 16 is placed, e.g., as a liquid, a liquid residue, or a solid residue on a conducting surface 4 or a non-conducting surface 4. Conducting surface 4 is composed of selected materials as described herein including, but not limited to, e.g., a metal foil, a metal alloy foil, or a modified (e.g., coated with a volatile organic) conducting surface. A non-conducting surface 4 is composed of selected materials described herein including, but not limited to, e.g., resins, glasses, ceramics, ceramic glasses, plastics, or other non-conducting or modified surfaces. The surface 4 containing the analyte is then loaded or staged on a sampling disc or plate (not shown) and then inserted directly into, or near, the path length of UV-LED source 2 located within the enclosure of housing 10 prior to ionization. In one exemplary configuration, UV-LED source 2 was set approximately 3 cm from the sample inlet 22 of a API 5000 mass spectrometer 30 (AB Sciex, Foster City, Calif., USA) used for gathering low-mass range data at room temperature, but is not limited thereto. In this configuration, the sample cone 22 voltage of the API 5000 spectrometer 30 was set at −30V, but is not limited thereto. In another exemplary configuration, UV-LED source 2 was set approximately 3 cm from the sample inlet 22 of an Exactive Orbitrap mass spectrometer 30 (Thermo Fischer, Waltham, Mass., USA). In the Orbitrap configuration, capillary temperature was set to 275° C., capillary voltage was set at −35V, tube lens was set at 60V, and skimmer voltage was set at 28V. A nitrogen flow gas from the sheath/auxiliary/sweep (not shown) was set to a minimum to maximize ion entrance into the mass analyzer 30. Conducting surface 4 is located within the focal length of UV-LED source 2. Light emanating from UV-LED source 2 is directed to conducting surface 4 held at a selected potential, e.g.,~−100 V. Voltages are selected that allow: photoemission of electrons from conductive surface 4 and ion steering of resultant reagent ions or analyte ions. Voltages are not limited.

Conducting Surfaces

Conducting surfaces that generate UV-photoemission electrons suitable for ionization of analytes in conjunction with the invention include, but are not limited to, e.g., metal surfaces, metalloid surfaces, alloy surfaces, polymer surfaces, including combinations of these various surfaces. Metal surfaces that serve as photoemission sources include, but are not limited to, e.g., aluminum (Al), cadmium (Cd), copper (Cu), gold (Au), iron (Fe), lead (Pb), palladium (Pd), titanium (Ti), and combinations of these various metals. Metalloid surfaces include, but are not limited to, e.g, silicon (Si), and germanium (Ge). Alloy surfaces include, but are not limited to, e.g, stainless steel, brass, Ni:Cr, Ni:Cr:Co and like alloys. Polymer surfaces include materials selected from: polysiloxanes, carbon-nanotubes, non-stick coatings (e.g., TEFLON®), molecule-specific coatings, broad surface-binding coatings, including combinations of these various materials. Conducting surfaces that include these various materials have a sufficiently low work function ($\phi$) that generates photoemission electrons when exposed to UV light. Conducting surfaces may further include a modified surface. In some embodiments, the analyte or sample is placed on a non-conducting surface located in proximity to a conductive surface that generates the photoemission electrons. In some embodiments, the modified surface includes a metal coating of a same or different metal. In other embodiments, the modified surface includes an oxidized metal of a same or different metal. For example, various metals can oxidize in ambient air to form a patina layer that covers the effective surface of the metal. In yet other embodiments, the modified surface includes a polymer coating. Polymer coatings include materials selected from: polysiloxanes, carbon-nanotubes, non-stick coatings (e.g., TEFLON®), molecule-specific coatings, broad surface-binding coatings, including combinations of these various coating materials. In other embodiments, modified surfaces include surfaces that are modified with various metals, metal oxides, and other materials including, but not limited to, e.g., conductive polymers and glass materials that are modified to include a dopant or another surface that lowers the work function sufficiently to releases photoemission electrons are also considered within the scope of this work.

Photoemission Ionization

Figure 2:
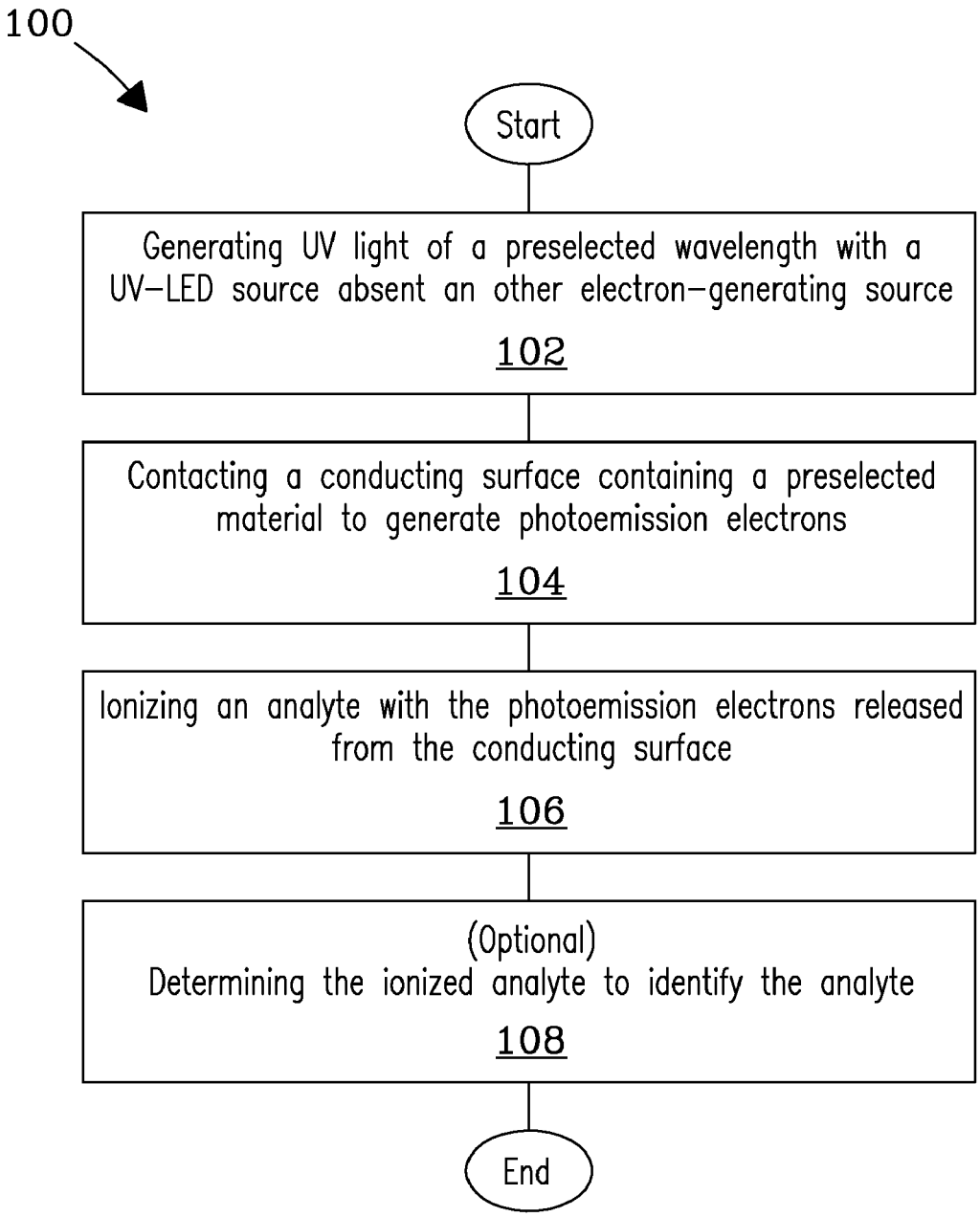
FIG. 2 shows exemplary steps of a UV-LED ionization process for generating photoemission electrons, according to one embodiment of the invention.

Photoemission electrons released from various conducting surfaces and modified conducting surfaces provide ionization of analytes either directly or indirectly, as detailed further herein. FIG. 2 illustrates exemplary steps for a' UV-LED ionization process 100 for generating photoemission electrons, according to one embodiment of the invention. {START} In a first step {Step 102}, the UV-LED photoemission ionization process 100 includes generating UV light 6 of a preselected wavelength with UV-LED source 2 in the absence of an other electron-generating source. In another step {Step 104}, UV light 6 from UV-LED source 2 contacts a conducting surface 4 composed of a selected material or materials described herein located adjacent the UV-LED source 2 to generate photoemission electrons 8 from the conducting surface 4 when energy of the UV light 6 exceeds the work function upon contact with the conducting surface 4. In another step {Step 106}, a preselected analyte 16 is ionized in concert with photoemission electrons 8 released from conducting surface 4 either directly or indirectly as detailed further herein. In another step {Step 108}, process 100 can further include the step of determining the ionized analyte 12 in an ion analyzer 30 for identification of the analyte 16. In the figure, various reactions are shown that involve photoemission electrons 8 released from conducting surface 4 that provide indirect ionization or direct electron capture ionization of analytes 16. {END}. TABLE 1 lists some example work function (ϕ) values (i.e., minimum photon energy required to generate photoemission electrons) for common metal and metal oxide conducting surfaces and approximate energies for the photoemission electrons generated.

TABLE 1

Work function (Φ) values of common metals and UV photon energies (hv).

| Element | Φ [nm] | Φ [eV] | ΔE (240 nm) [5.17 eV] | ΔE (280 nm) [4.43 eV] |
|---|---|---|---|---|
| Platinum | 196 | 6.35 | −1.18* | −1.92* |
| Palladium | 242 | 5.6 | −0.43 | −1.17* |
| Gold | 243 | 5.1 | 0.07 | −0.67* |
| Copper | 264 | 4.7 | 0.47 | −0.27* |
| Iron | 264 | 4.7 | 0.47 | −0.27* |
| Stainless Steel | 282 | 4.4 | 0.77 | 0.03 |
| Aluminum | 304 | 4.25 | 0.92 | 0.18 |
| Gold (oxidized film | 296 | 4.19 | 0.98 | 0.24 |
| Titanium | 296 | 4.11 | 1.06 | 0.32 |
| Cadmium | 304 | 4.08 | 1.09 | 0.35 |
| Aluminum Oxide | 310 | 4.0 | 1.17 | 0.43 |
| Lead | 310 | 4.0 | 1.17 | 0.43 |
| Palladium Oxide | 318 | 3.9 | 1.27 | 0.53 |
| Lead Oxide | 327 | 3.8 | 1.37 | 0.63 |

*Negative (minus) values result in little to no electron generation unless the surface is otherwise modified. Positive values are viable metal surfaces for photoemission ionization with UV light (herein at 240 nm and 280 nm, respectively).

As shown in TABLE 1, energy of the initial photoemission electron from a non-oxidized aluminum surface irradiated with 280 nm UV light is 0.18 eV. For a stainless steel surface, energy of the photoemission electron with 280 nm UV light is 0.03 eV. Metal oxide surfaces typically have a higher effective work function upon oxidation. However, oxides of zinc and aluminum yield lower effective work function values upon oxidation. Thin oxide layers on gold also lower the threshold for photoemission by up to 1 eV. Exposure of many metal surfaces to atmosphere may also lower the work function due to thin-layers of organic residues or chemisorptions from the atmosphere.

Efficiency of photoelectron generation is another factor for selection of metal conducting surfaces for photoemission applications. At 5 eV, for example, stainless steel yields $10^{-6}$ electrons per photon. At an equal light intensity, aluminum yields $10^{-5}$ electrons/photon, providing a 10× greater yield of photoemission electrons per photon compared with stainless steel. Based on photon flux data for the UV-LED source, the photoelectron yield for the aluminum surface corresponds to an expected electron current of 0.5 nW ($3\times10^{9}$ electrons/sec) at 240 nm or 10 nW ($7\times10^{10}$ electrons/sec) at 280 nm. For the stainless steel surface, the photoelectron yield corresponds to an expected electron current of 0.05 nW ($3\times10^{8}$ electrons/sec) at 240 nm or 1 nW ($7\times10^{9}$ electrons/sec) at 280 nm.

Figure 3A:
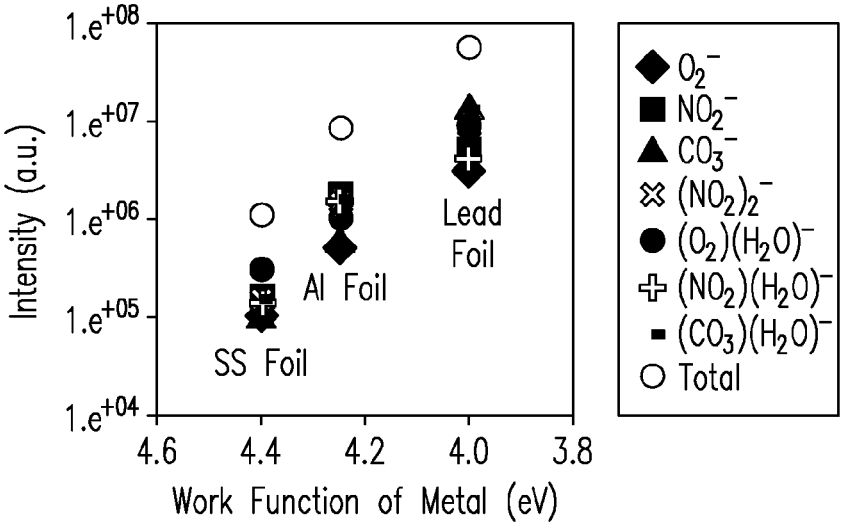
FIG. 3*a* plots signal intensity of reagent/background ions produced with one embodiment of the invention from various conducting surfaces in open air.
Figure 3B:
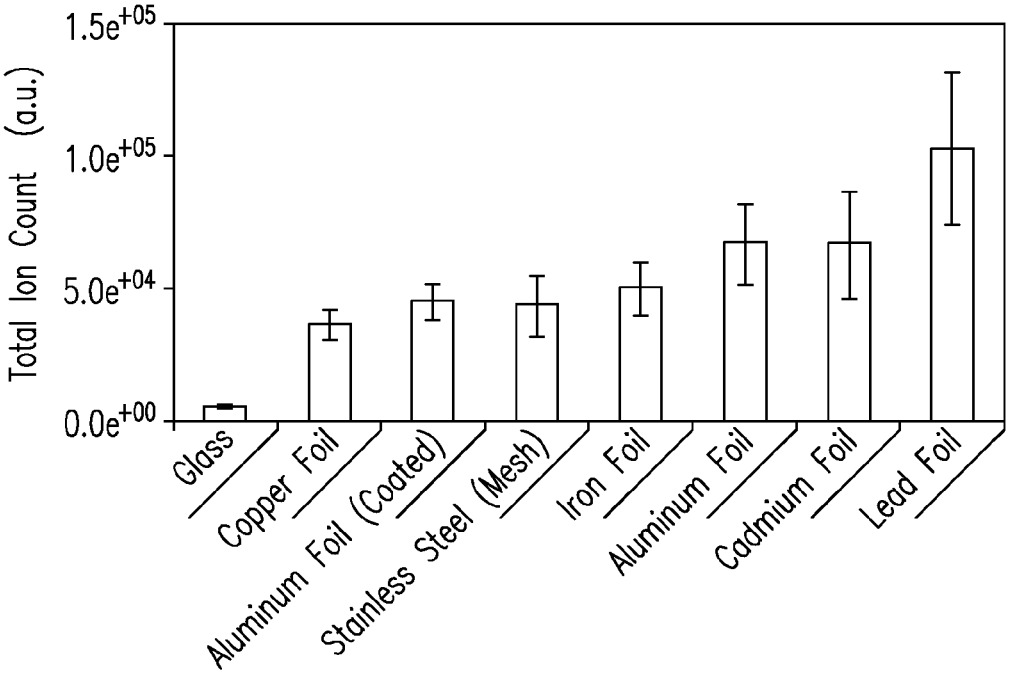
FIG. 3*b* plots total ion count (TIC) produced with another embodiment of the invention from various metal conducting surfaces.

FIG. 3*a* plots total ion count (signal intensity) generated from various metal surfaces positioned in open air (i.e., external to the ion source of FIG. 1) versus work function (ϕ) of these surfaces at atmospheric pressure and room temperature. In this embodiment, the absence of a surrounding (i.e., counter) potential field allows photoemission electrons to be rapidly released from the selected surfaces. In the figure, stainless steel shows a low intensity compared with other metal surfaces, but ionization still occurs. FIG. 3*b* plots total ion count as a function various metal surfaces enclosed within the UV-LED ionization (ion) source described previously in reference to FIG. 1. In both embodiments, test data show that any conductive surface can work for ionization in accordance with the invention as long as the energy of the incident UV photon (hv) from the UV-LED source (e.g., FIG. 1) exceeds the work function (ϕ) of the conducting surface. Thus, no limitations are intended to exemplary conducting surfaces described herein. A photoelectron with the expected energy difference is then generated. Further, if a non-conducting surface is used to hold the sample, generation of photoemission electrons and resultant reagent ions can still occur on proximal surfaces via stray light or by deliberately repositioning of the light onto the proximal metal surface. The resulting ions can then ionize either the sample on the non-conducting surface or in the headspace above the non-conducting surface.

Figure 4A:
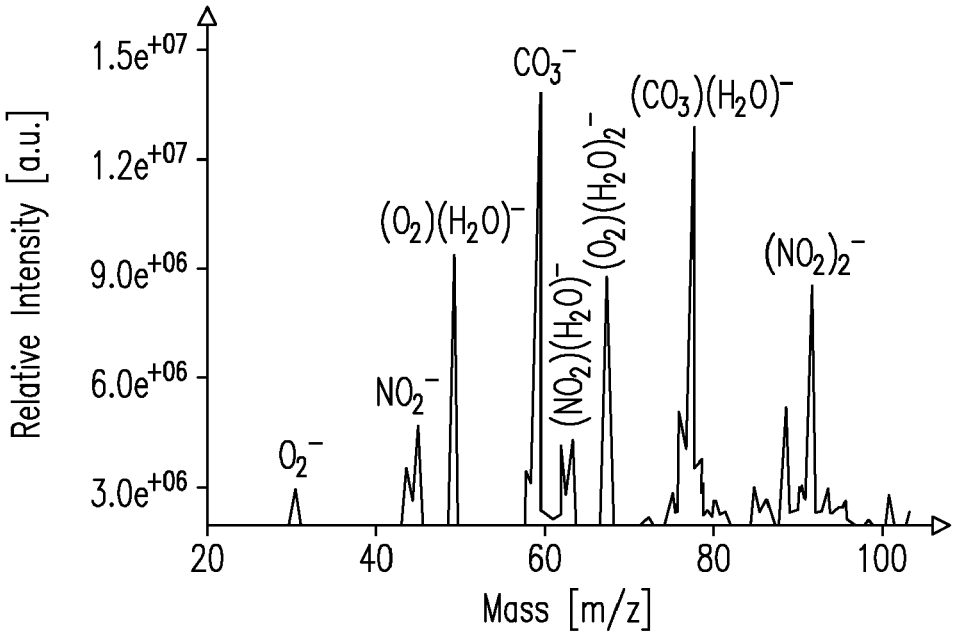
FIGS. 4*a*-4*c* present mass spectra showing background ions produced with one embodiment of the invention from different metal foil surfaces.
Figure 4B:
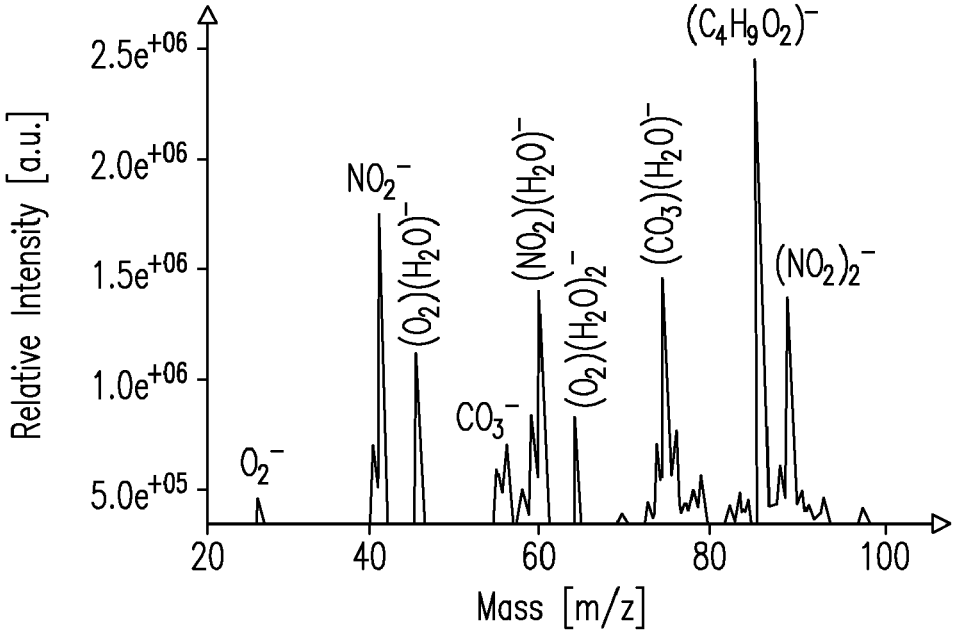
Figure 4C:
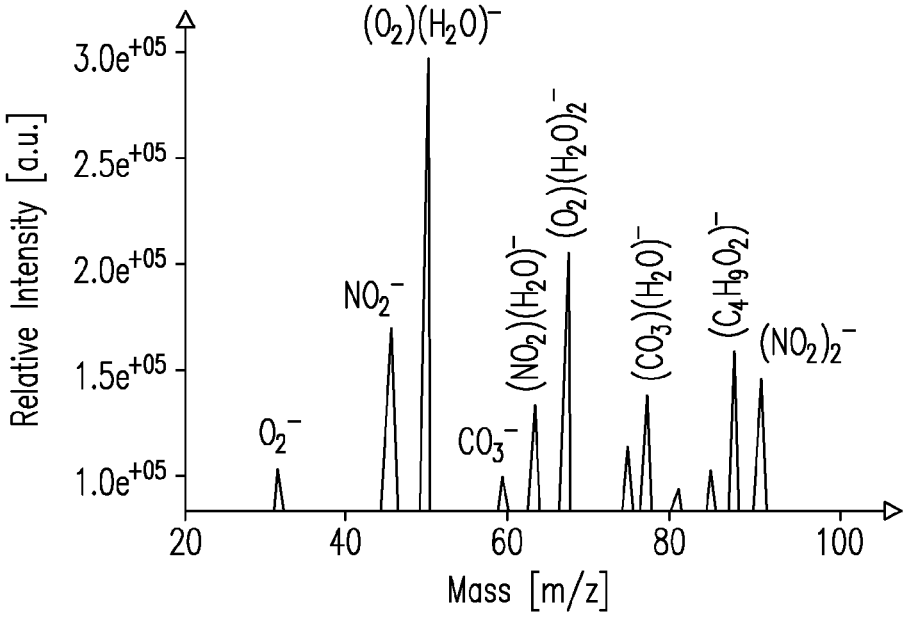

FIGS. 4*a*-4*c* present mass spectra showing background ions obtained in air at ambient temperature using the UV-LED source as the UV light (280 nm) irradiated three different conducting (i.e., metal foil) surfaces including, e.g., a lead foil (FIG. 4*a*), an aluminum foil (FIG. 4*b*) and a stainless steel foil (FIG. 4*c*), respectively. Mass assignments are shown. Conducting surfaces composed of the selected metal surface were positioned 0.5 cm from the sampling inlet of the sample cone leading to the ion analyzer, which was held at a non-limiting surface potential of −100V. FIG. 4*a* shows background ions generated as UV light irradiates a conducting surface of lead foil. FIG. 4*b* shows background ions generated as UV light from the UV-LED source irradiated a conducting surface composed of an oxidized aluminum foil. FIG. 4*c* shows background ions generated as UV light from the UV-LED source irradiated a conducting surface composed of stainless steel. Results indicate that where UV light impinges the metal surface (i.e., location) can increase ion generation. Thus, the volume (e.g., headspace volume) in which photoemission electrons and their pursuant ions are generated is preferably located proximal to the sample inlet (i.e., sampling orifice) to the mass analyzer. Results are consistent with those obtained with other atmospheric pressure ionization sources, indicating that the greatest ion transmission to the MS analyzer occurs when ions are generated closest to the sample cone inlet. While initial electron energies from aluminum (0.18 eV) are higher than for stainless steel (0.03 eV), given the rapid thermalization (i.e., within 45 nsec), electrons are energetically equivalent. The mass spectra indicate that generated ions include water clusters and oxygen ions. Resulting total ion counts (TICs) (see FIGS. 4*a*-4*c*) also indicate there is a correlation between resulting ion intensity and work function (ϕ) of the metal used as the photoemissive surface. In short, the larger the energy difference between the photon energy and work function (ϕ) of the metal surface, the greater the resulting intensity of ions generated. Photoelectrons can be generated on some metal surfaces with a UV-LED, generating UV light with a wavelength of 240 nm (equivalent to an energy of 5.2 eV), while a UV-LED with a lower energy of 280 nm impinging on the same metal surface may not result in significant photoemission. Presence of electric fields within the UV-LED source plays a role in ion generation and ion conduction prior to entry into an ion analyzer. By shaping potential fields, electrons can be efficiently directed towards the desired ionization volume into the ion analyzer. TABLE 2 lists the top five (5) dominant (background) ions generated for various conducting surfaces at room temperature.

TABLE 2

Top 5 (and $O_2^-$) dominant background ions and relative intensities generated from metalized surfaces exposed to UV light at room temperature.

| Ion (m/z) | Probable Ion | (Pb) Foil | (Al) Foil | (Cd) Foil | Stainless Steel Foil | (Fe) Foil | Co:Ni:Cr Foil |
|---|---|---|---|---|---|---|---|
| 32.0 | $O_2^-$ | 1E+06 | 2E+05 | 3E+06 | 4E+04 | 2E+04 | (nd)* |
| 46.0 | $NO_2^-$ | | 2E+06 | | 1E+05 | | 2E+04 |
| 50.0 | $O_2(H_2O)^-$ | 8E+06 | | 2E+07 | 3E+05 | 1E+05 | 4E+04 |
| 60.0 | $CO_3^-$ | 1E+07 | | 5E+07 | | 8E+04 | 3E+04 |
| 64.0 | $(NO_2)(H_2O)^-$ | | 2E+06 | | | | |
| 68.0 | $(O_2)(H_2O)_2^-$ | 8E+06 | | 2E+07 | 2E+05 | 1E+05 | 4E+04 |
| 78.0 | $(CO_3)(H_2O)^-$ | 1E+07 | 2E+06 | 4E+07 | | 6E+04 | |
| 92.0 | $N_2O_4^-$ | 8E+06 | 2E+06 | 1E+07 | 1E+05 | | 1E+04 |

*(nd) = not determined

Although all metals produce small quantities of all ions listed in TABLE 2, three distinct ion-classes are typically produced: 1) metals that generate $O_2^-$ reagent ions predominantly, 2) metals that yield $NO_x^-$ reagent ions predominantly, and 3) metals that yield $CO_3^-$ reagent ions predominantly. Stainless steel and Co:Ni:Cr alloys generate $O_2^-$ reagent ions predominantly upon irradiation with low-energy UV light. Aluminum surfaces generate $NO_x^-$ reagent ions predominantly upon irradiation with low-energy UV light. Lead and cadmium surfaces generate $CO_3^-$ reagent ions predominantly upon irradiation with low-energy UV light. While ion generation described herein was demonstrated in atmospheric air resulting in chemical ionization typically involving $O_2^-$ reagent ions, the ion generation process can also be achieved with other reagent (electrophillic) gases capable of receiving the photoemission electron from the conducting surface, including, but not limited to, e.g., $SF_6$, $CF_4$ $NO_2$, OH, $O_2$, $O_3$, $CH_3OH$, $CH_3CN$, $CH_3COOH$, HCl, $NH_3$, $CH_4$, $CH_2Cl_2$, $CF_2Cl_2$, $C_4H_{10}$, $SO_2F_2$, halogenated hydrocarbons, as well as combinations of these various gases. Thus, no limitations are intended. Other background ions include, but are not limited to, e.g., $HCO_2^-$ (m/z 45); $O_2(H_2O)^-$ (m/z 50); $CO_3^-$ (m/z 59.99); $H_2O(HCO_2)^-$ (m/z 63); $O_2(H_2O_2)^-$ (m/z 68); $O_2(HCO_2)^-$ (m/z 77); $[(C_4H_{10}O_2)—H]^-$ (m/z 89); $[H_2O(C_4H_{10}O_2)—H]^-$ (m/z 107); and $O_2(C_4H_{10}O_2)^-$ (m/z 121). Thus, no limitations are intended.

Analytes

Analytes may be ionized directly as vapor-phase analytes, or be ionized directly from conducting surface into the headspace above conducting surface. Analytes may be of any form that is volatile including, but not limited to, e.g., liquids, residues, powders, particles, suspensions, vapors, bound-species, and combinations of these various analyte forms. In exemplary tests, several classes of organic vapors were analyzed and found to be effectively detected. Detected organic vapors include, but are not limited to, e.g., organic acids, heterocyclic aromatics, and halo-organic solvents. Electronegative molecules are preferred for vapor detection, but are not limited thereto. Ion types resulting from ionization are principally from two chief pathways: 1) reaction with an atmospheric reagent molecule or 2) via electron capture. For example, a dominant ionization pathway for organic vapors involves photoemission from an oxidized conducting surface (e.g., an oxidized metal surface), electron capture by oxygen, and then proton abstraction (removal) of the analyte. A primary benefit of UV-LED source is the ability to generate ions for detection of several classes of organic vapors without the need of high-energy potential fields or low pressure vacuum systems. In some embodiments, for example, an analyte may placed on conducting surface as a liquid prior to being ionized or may be ionized as a dry residue from conducting surface. Thus, no limitations are intended. Ionization then proceeds by exposing conducting surface to UV light emanating from UV-LED ion source. Ionized analytes are subsequently introduced as vapor-phase analytes into an ion analyzer (e.g., MS, IMS) positioned adjacent the conducting surface via air flow (i.e., suction) or ion steering.

Figure 5A:
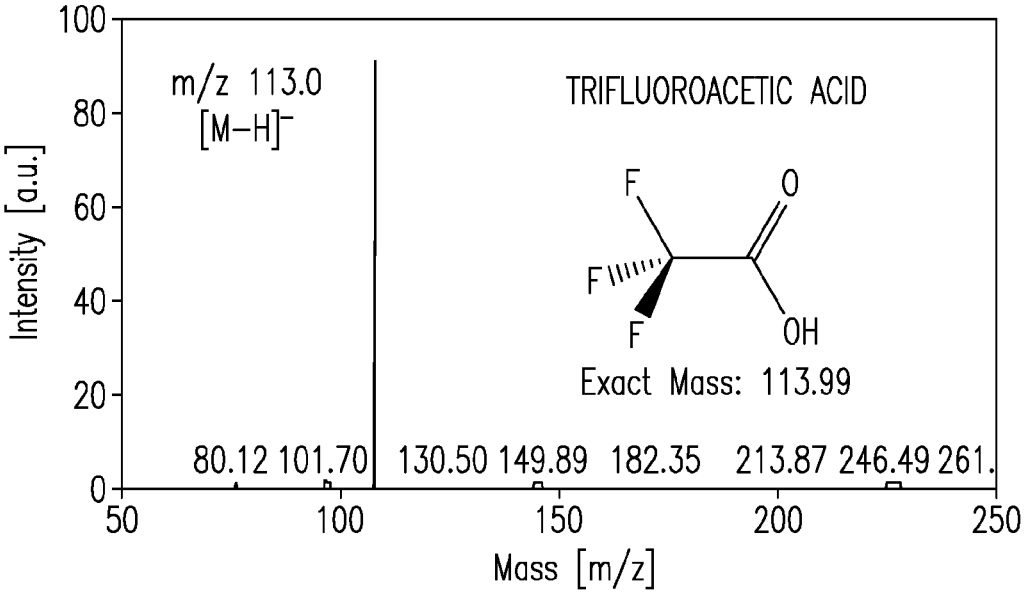
FIGS. 5*a*-5*b* present mass spectra for two organic compounds ionized from a metal surface with one embodiment of the invention.
Figure 5B:
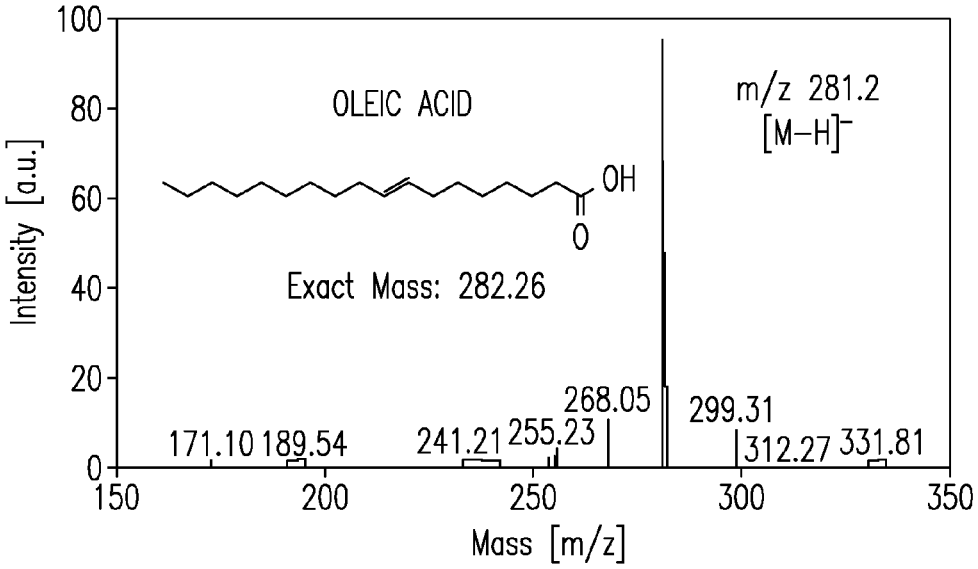

FIGS. 5*a*-5*b* present mass spectra for two organic acids, Trifluoroacetic acid (TFA) (100 mM), (Agilent, Santa Clara, Calif., USA) and Oleic acid (CAS #112-80-1) (Sigma-Aldrich, St. Louis, Mo.) that were present as dry residues on the conducting surface made, e.g., of an aluminum foil (e.g., Reynold's Aluminum Foil®). Metal foil types suitable for use with the invention are not limited. Solutions were either used directly or diluted with methanol prior to analysis. A small drop (5 μL) was placed on the aluminum foil blank a few millimeters (mm) from the entrance to the mass spectrometer. The acids were analyzed from off the conducting surface with the UV-LED source described previously in reference to FIG. 1. Headspace vapors for these compounds were subsequently analyzed. Other dry surface residues containing other volatile organics were also ionized from off the conducting surface including, but not limited to, e.g., 1-Octadecene (CAS #112-88-9) (10 ppth), Decanol (CAS #112-30-1) (10 ppth), Purine (CAS #120-73-0) (5 mM), and Dichloromethane (75-09-2) (purum). Results demonstrate that dry residues of volatile organics ionized from off metal foils are measured as ions generated via: 1) proton abstraction (e.g., yielding $[M-H]^-$) or 2) chemical adduct formation of the analyte residue with an organic component found on the surface of the foil.

Figure 6A:
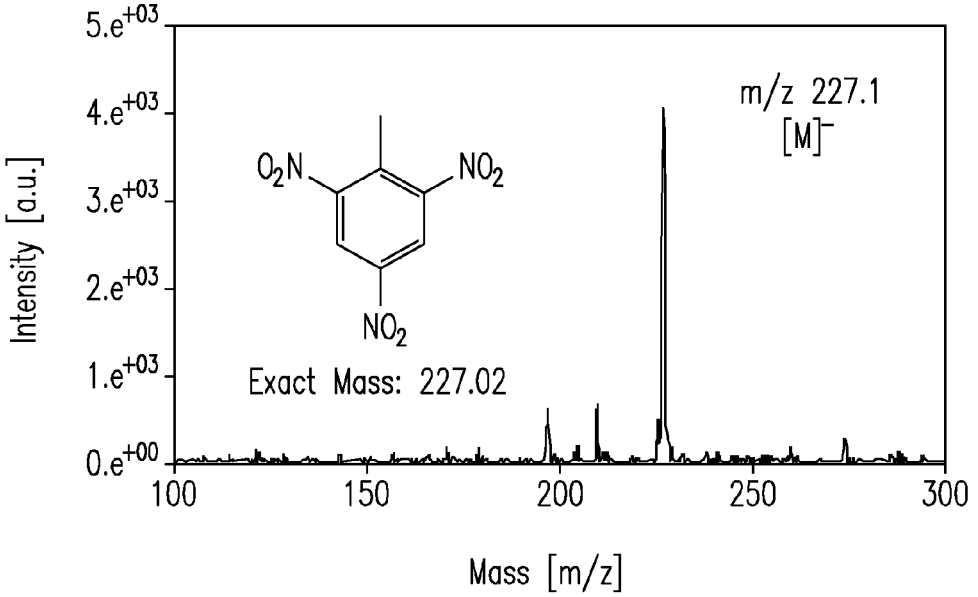
FIG. 6*a* is a mass spectrum for an exemplary explosive residue ionized from a metal surface, according to an embodiment of the invention.
Figure 6B:
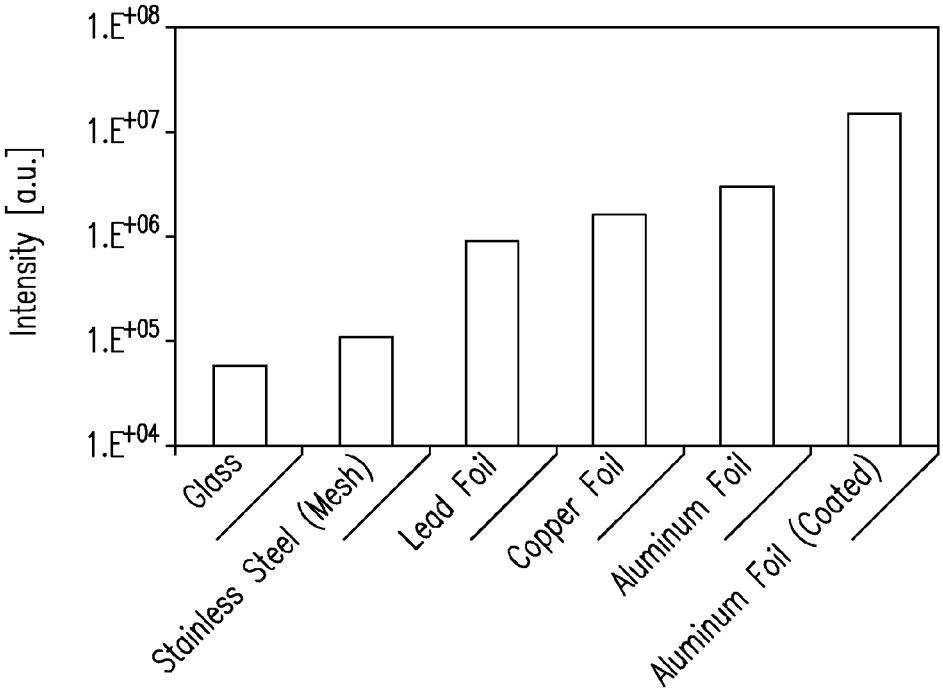
FIG. 6*b* is a plot showing signal intensity for an exemplary explosive ionized from various surfaces, according to various embodiments of the invention.

FIG. 6*a* is a mass spectrum from analyses of a 1 μg surface residue of trinitrotoluene (TNT) that was ionized from a metal foil surface (e.g., aluminum foil) with the UV-LED ionization source (FIG. 1) in accordance with the invention. FIG. 6*b* plots signal intensity of ions generated with the UV-LED ionization source from analyses of 100 ng surface residues of Trinitrotoluene (TNT) from various conducting (i.e., metal foil) surfaces. While analysis of TNT is demonstrated, explosives are not limited thereto. The explosive standard containing TNT (CAS #118-96-7) (500 ppm) (M-8330-11) [or other explosives including, e.g., RDX (M-8330-05) and PETN (M-8330-ADD-2)] was purchased (AccuStandard, New Haven, Conn.) as a 1 mg/mL solution in methanol:acetonitrile or methanol alone (e.g., PETN). Solutions were diluted with acetonitrile to a working concentration of 100 ng/μL, and then 5 μL were delivered to the surface via syringe and allowed to dry.

In other exemplary tests, both liquid samples and dry residues of TNT were ionized by proton abstraction, whereas low-volatile, dry residues of RDX and PETN ionized by adduct formation. Trinitrotoluene (500 ppm) was found to be measured at nanogram quantities off conducting metal surfaces. Results demonstrate that the UV-LED source (FIG. 1) can measure volatile organics using low-energy UV light, either in the gas phase or ionizing the volatile organics as dry residues via photoemission electrons from off the conducting surface. Further, these low-energy electrons either directly ionize volatile explosives (TNT) present in the headspace over liquid drops or indirectly ionize it via $[O_2]^-$ or $[OH]^-$ reagent ions. Low-volatile organics including, e.g., explosives, e.g., RDX and PETN, cannot be directly measured in the headspace over such liquid drops. However, these low-volatile species are found to form bound complexes.

Advantages

The UV-LED photoemission ionization source (see FIG. 1) and process (see FIG. 2) of the invention solve known problems in the prior art for detection of organic species and surface residues. The unique ability of the present invention to generate small photocurrents in certain metals and other conducting surfaces provides attractive features. The present invention with its low-power, scalable UV-LED ionization source may be integrated into next generation, compact mass spectrometers to create ultra compact, hand-held gas analyzers. Benefits are numerous. First, the complexity and cost of the ion source are substantially reduced. Second, the UV-LED source is robust compared with conventional lamps, lasers, and electron filaments. The UV-LED ionization source of the invention provides UV light of a sufficient energy to ionize many diverse analytes, generating ions of organic vapors that provide for detection without the need of high-energy potential fields or low pressure vacuum systems. For example, conventional El sources must operate at a reduced pressure due to requirements of the high temperature, delicate electron filament. Since the sensitivity of these El instruments is proportional to the number of ions generated within the sampled gas, ionization occurs at a reduced pressure, which severely limits the maximum sensitivity of these instruments. Third, the ion source of the invention requires few if any additional electric fields within the ion source device. Fourth, the present invention easily generates ions at atmospheric pressure, which can increase ion intensity and reduce size of the device. As described herein, use of a conducting surface that has a sufficiently low work function (e.g., <4.4 eV for 280 nm UV light) can be used as a source of photoemission electrons. Modifying the surface (e.g., via oxidation or organic film deposition) can further lower the work function, which increase the types of conductive surfaces available as a photoemissive surface. Selecting higher-energy UV-LEDs can also extend the range of material selections for photoemissive surfaces. The UV-LED ionization depends on the photon energy of the light and the light source used. Fourth, the present invention provides a greater potential analyte density compared to low-pressure ion sources, as the maximum analyte density, e.g., at one (1) atmosphere, is significantly greater than that at a reduced pressure.

The following examples provide a further understanding of the invention in one or more aspects.

Example 1

Background Tests

Ambient air was analyzed using a UV-LED source (FIG. 1) with the UV-LED "on" or "off" that involves monitoring and sampling of negative ions. A mass analyzer (MS) was set to monitor total ion count (TIC) from m/z 10 to m/z 400. UV-LED source was switched "on" by shining UV light onto a metal foil positioned, e.g., 0.5 cm from MS inlet, or "off". A voltage of −500V was applied to the selected metal foil, and a voltage of −10V was applied to the cone surface.

Example 2

Background Ions from Oxidized Aluminum Conducting Surface

In one test, background ions were generated in air at ambient temperature using a single UV-LED illuminating the conducting surface composed of oxidized aluminum. A background ion mixture resulting from UV light (280 nm) from a UV-LED source striking the conducting surface located near the sample cone was determined with an API 5000 atmospheric-sampling mass analyzer situated adjacent to UV-LED source. The sample cone was set to a potential of −7V. UV light from the UV-LED was set to strike the sample cone ~0.5 cm from the MS inlet. The oxidized surface with the thin oxide film substantially lowered the work function of the material to 4.0 eV (compared to 4.23 eV for a non-oxidized aluminum), which occurs naturally at atmospheric pressure in room air. Work function for generation of photoelectrons on the non-oxidized surface is at the minimum necessary value to permit photoemission generation when exposed to 280 nm UV light.

Example 3

Background Ions from Stainless Steel Conducting Surface

In another test, background ions were generated in sufficient quantity in air when a single UV-LED illuminated a conducting surface made of oxidized stainless steel at ambient temperature. Background ion mixture resulting from UV light (280 nm) from a UV-LED source striking a conducting surface located near a sample cone was determined with an API 5000 atmospheric-sampling mass analyzer situated adjacent to UV-LED source. Background ion mixture resulting from UV light (280 nm) striking a stainless steel metal surface was determined using an API 5000 atmospheric-sampling mass analyzer coupled to the UV-LED source. The sample cone was set to a potential of −7V. UV light from the UV-LED was set to strike the sample cone −0.5 cm from the MS inlet. UV light from UV-LED source was set to strike the sample cone just below the inlet to the mass analyzer. The stainless steel metal surface has a work function that is just sufficient (4.4 eV) to permit photoemission generation when exposed to 280 nm light.

Example 4

Modified Surfaces Including Surface Coatings

In another test, background ions were generated in sufficient quantity in air when a single UV-LED illuminated a conducting surface made of aluminum, coated with a thin layer of non-stick coating, composed of polysiloxane and other minor components (e.g., acrylic acid, ethyl acetate and butyl acetate) at ambient temperature. Background ion mixture resulting from UV light (280 nm) from a UV-LED source striking a conducting surface located near a sample cone, which was determined with an API 5000 atmospheric-sampling mass analyzer situated adjacent to UV-LED source.

Background ion mixture resulting from UV light (280 nm) striking an stainless steel metal surface was determined using an API 5000 atmospheric-sampling mass analyzer coupled to the UV-LED source. The sample cone was set to a potential of −7V. UV light from the UV-LED was set to strike the sample cone −0.5 cm from the MS inlet. UV light from UV-LED source was set to strike the sample cone just below the inlet to mass analyzer. The polymer-coated aluminum surface generated similar ion intensities and types of ions as the non-coated aluminum surface.

Example 5

Analyte: Dichloromethane

In other experiments, analyte ions were generated using UV-LED photoemission ionization source at ambient pressure by sampling the headspace of several gas-phase organic compounds. Ions observed result from either reaction with an atmospheric reagent molecule or electron capture. In one test, Dichloromethane ($CH_2Cl_2$) (CAS #75-09-2) (ionization potential=11.32 eV) (Sigma Aldrich, St. Louis, Mo., USA) was analyzed. A Q-tip cotton swab moist with dichloromethane was placed an inch away from the UV-LED source. The ion signature was monitored by sampling the headspace above the aluminum metal surface. The headspace volume containing the ionized dichloromethane analyte was analyzed in an API 5000 mass spectrometer. Results showed the dominant ion ($Cl^-$) for dichloromethane was a result of electron induced dissociation (EID), whereas most larger organic solvents resulted in electron attachment, charge transfer, proton abstraction $(M\text{-}H)^-$ or other fragmentation reactions.

While exemplary embodiments of the present invention have been shown and described herein, it will be apparent to those skilled in the art that many changes and modifications may be made without departing from the invention in its true scope and broader aspects. The appended claims are therefore intended to cover all such changes and modifications as fall within the spirit and scope of the invention.

What is claimed is:

1. A UV-photoemission ionization apparatus for indirect ionization or direct electron capture ionization of analytes for ion analysis, characterized by:

a UV-LED source absent an other electron-generating source disposed adjacent a conducting surface comprising a preselected material, said source produces UV light of a preselected wavelength that generates photoemission electrons from said conducting surface that ionize an analyte upon contact with same when energy of the UV light exceeds the work function of the surface material upon contact with said surface.

2. The apparatus of claim 1, wherein the UV light is non-coherent UV light.

3. The apparatus of claim 1, wherein the UV-LED source produces UV light with a wavelength of from 200 nm to 400 nm.

4. The apparatus of claim 1, wherein the UV LED source produces a quantity of ozone below 100 parts per billion (ppb) as a by-product of the ionization of said analyte.

5. The apparatus of claim 1, wherein the conducting surface includes a metal.

6. The apparatus of claim 5, wherein the metal surface includes a member selected from: a mesh, a foil, a coating, or a bulk material.

7. The apparatus of claim 1, wherein the conducting surface includes a metal alloy.

8. The apparatus of claim 7, wherein the metal alloy is stainless steel.

9. The apparatus of claim 1, wherein the conducting surface includes a metalloid.

10. The apparatus of claim 1, wherein the conducting surface includes a modified surface that includes a metal coating or an oxidized metal.

11. The apparatus of claim 1, wherein the conducting surface includes a modified surface that includes a polymer coating or a conductive polymer coating.

12. The apparatus of claim 1, wherein the UV-LED source is located in the same ionization volume as the analyte.

13. The apparatus of claim 1, wherein the UV-LED source is operatively coupled to an ion analyzer disposed adjacent said conducting surface.

14. The apparatus of claim 1, wherein the analyte is disposed on the conducting surface.

15. The apparatus of claim 1, wherein the analyte is a vapor-phase analyte.

16. The apparatus of claim 1, wherein the analyte is disposed on a non-conducting surface and ionized by photoemission electrons released from the conducting surface.

17. The apparatus of claim 1, wherein the analyte is an explosive.

18. The apparatus of claim 1, wherein ionization of the analyte occurs at a pressure at or above ambient pressure.

19. The apparatus of claim 1, wherein ionization of the analyte occurs at a pressure below atmospheric pressure.

20. The apparatus of claim 1, wherein ionization of the analyte occurs at a temperature greater than or equal to ambient temperature.

21. The apparatus of claim 1, wherein ionization of the analyte occurs at a temperature less than or equal to ambient temperature.

22. A method for UV-LED photoemission ionization for indirect ionization or direct ionization of analytes for ion analysis, the method comprising:

generating UV light of a preselected wavelength with a UV-LED source absent an other electron-generating source;

contacting a conducting surface comprising a preselected material disposed adjacent said UV-LED source with said UV light to generate photoemission photoelectrons from the conducting surface when energy of the UV light exceeds the work function upon contact with the conducting surface; and ionizing a preselected analyte with photoemission electrons released from the conducting surface directly or indirectly upon contact with same.

23. The method of claim 22, wherein the ionizing involves a proton abstraction reaction.

24. The method of claim 22, wherein the ionizing involves formation of a chemical adduct in the vapor phase.

25. The method of claim 22, wherein the ionizing involves a charge transfer reaction with a reagent gas.

26. The method of claim 25, wherein the reagent gas is selected from the group consisting of: $SF_6$, $NO_2$, OH, $O_2$, $O_3$, $CH_3OH$, $CH_3CN$, $CH_3COOH$, HCl, $NH_3$, $CH_4$, $CH_2Cl_2$, $CF_2Cl_2$, $C_4H_{10}$, halogenated hydrocarbons, and combinations thereof.

27. The method of claim 22, wherein the ionizing involves an electron capture reaction with the photoemission electrons.

28. The method of claim 22, wherein the ionizing involves an electron capture reaction with oxygen.

29. The method of claim 22, wherein the ionizing occurs in the same volume where the UV-LED source is located.

30. The method of claim 22, wherein the ionizing includes ionizing the analyte from a non-conducting surface with photoemission electrons released from the conducting surface.

31. The method of claim 22, wherein the analyte is an explosive.

32. The method of claim 22, further including the step of determining the ionized analyte in an ion analyzer for identification thereof.

* * * * *